United States Patent [19]

Reynolds

[11] 4,368,507

[45] Jan. 11, 1983

[54] FLASHLIGHT

[76] Inventor: Edward J. Reynolds, 37-10 223rd St., Bayside, N.Y. 11361

[21] Appl. No.: 54,467

[22] Filed: Jul. 3, 1979

[51] Int. Cl.[3] ..... F21L 7/06

[52] U.S. Cl. ..... 362/200; 362/189; 362/208; 362/253; 362/362

[58] Field of Search ..... 362/200, 189, 208, 253, 362/362

[56] References Cited

U.S. PATENT DOCUMENTS

| | | | |
|---|---|---|---|
| 4,250,539 | 2/1981 | Leitzel | 362/200 |
| 4,285,030 | 8/1981 | Menelly | 362/200 |

*Primary Examiner*—Stephen J. Lechert, Jr.

*Attorney, Agent, or Firm*—Kenyon & Kenyon

[57] ABSTRACT

A flashlight comprised of power source-containing and illuminating means-containing chambers particularly adapted to be powered by a substantially flat battery-containing power source having an exposed terminal on a surface thereof.

5 Claims, 2 Drawing Figures

FLASHLIGHT

The present invention relates to flashlights and, in particular, to battery-operated flashlights.

Although the structure of the flashlight of the present invention is applicable to operation with numerous power sources, it is particularly adapted to being powered by a unique power source. Thus, the flashlight is particularly designed so as to utilize a substantially flat (i.e., height dimension substantially less than length dimension) enclosed battery-containing power source having an exposed terminal or contact point on a surface thereof. Such a power source is, in particular, an instant photography film pack such as sold by Polaroid® for its instant photography cameras, e.g., the SX-70®. These film packs, in addition to unexposed film, contain one or more batteries which, in the camera, are used to drive a mechanism which ejects exposed film from the film pack and out of the camera and, in addition, for certain cameras, to operate a flash assembly. The power contained within these batteries is more than sufficient to operate a standard flashlight illuminating means (e.g., bulb and reflector). More importantly, because of the desire to avoid failures of either the film ejecting or flash operations powered by the batteries in the film pack, and, in addition, in recognition that substantial time may elapse between the manufacture and ultimate use of the battery-containing film packs, the power capacity of the batteries when the film pack is manufactured is generally substantially in excess of that needed to achieve the various intended functions. As a result, I have found that "spent" film packs, i.e., film packs fully used in operation of the instant camera, still contain sufficient residual energy to power a flashlight.

The flashlight of the present invention, in its particular applicability to being powered by a battery-containing film pack, affords a means for putting otherwise wasted energy to use. In addition, the flashlight affords a simple means for providing illumination in emergency situations where conventional batteries are not readily accessible.

In accordance with the present invention, the flashlight comprises a power source-containing chamber having a bottom wall and two side walls attached in substantially perpendicular arrangement to the bottom wall. A partition wall, which serves to separate the power source-containing chamber from a second chamber containing the flashlight illuminating means, functions as the front wall of the power source-containing chamber. The bottom, side and front walls of the power source-containing chamber serve to define a chamber particular adapted to receiving a substantially flat power source. This chamber further comprises means for substantially confining the power source in the chamber.

A second chamber for housing the illuminating means is defined by at least two spaced parallel walls, attached in a perpendicular manner to the partition wall, and a front wall attached to each of the spaced walls of the second chamber. The front wall contains an aperture through which light from the illuminating means can emit, and the illuminating means is attached behind this aperture and to the front wall. Means for establishing electrical contact between the illuminating means and the power source are attached to the partition and may comprise electrically conductive metal contacts adapted to electrically and/or physically engage exposed terminals of the illuminating means and the power source.

The invention will be further described with references to the drawings and the description which follows:

DETAILED DESCRIPTION OF THE INVENTION

Figure 1:
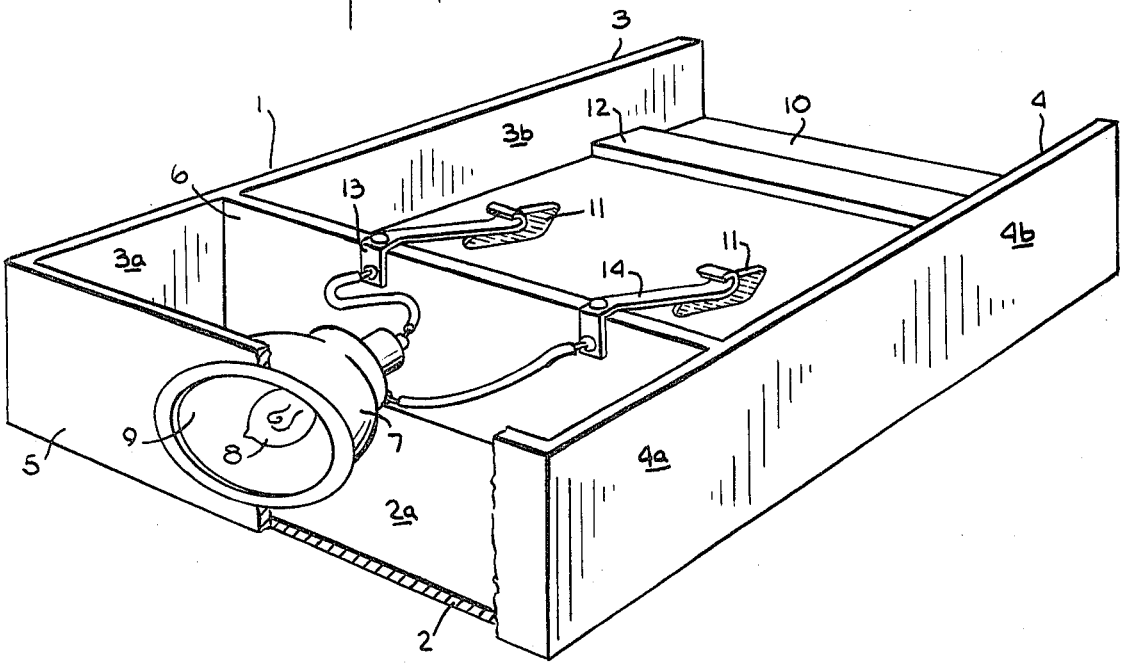
FIG. 1 is a view of the flashlight of this invention illustrating an embodiment wherein the walls of the power source-containing chamber and the second chamber are common and contiguous.

In FIG. 1 is shown an embodiment of the flashlight of the present invention wherein the housings for the power source and illuminating means are comprised of common, contiguous walls. Thus, the flashlight 1 is comprised of bottom wall 2 to which is attached by appropriate means, e.g., adhesives, nails, screws, side walls 3 and 4 extending vertically from and substantially perpendicular to bottom wall 2. The flashlight also contains front wall 5 having an aperture for emission of light from the flashlight. A partition wall 6 is disposed at a pre-determined distance parallel to and behind the front wall 5 to divide the flashlight into separate power source-containing and illuminating means—containing chambers of housings. In this embodiment, partition 6 is shown attached to bottom wall 2 and side walls 3 and 4. As is apparent, however, partition 6 may also be attached to only a single side wall, the side walls alone, or the bottom wall alone so long as sufficient structural strength is obtained thereby and so long as there exists separation of the power source from the illuminating means.

The illuminating means-containing chamber, defined by bottom wall portion 2*a*, sidewall portions 3*a* and 4*a*, front wall 5 and partition 6 is adapted to receive illuminating means comprised of reflector 7, bulb 8 and protective transparent cover 9 in position behind the aperture in front wall 5.

The power source-containing chamber, defined by bottom wall 2*b*, side walls 3*b* and 4*b*, and partition 6 is adapted to receive a power source 10 having exposed terminals on the upper side thereof, i.e., on the side opposite that facing bottom wall 2. In the embodiment shown in FIG. 1, power source 10 is shown as a substantially flat, rectangular encased package containing batteries internally therein, the terminals of which are arranged so as to emanate externally in exposed terminals 11. In particular, power source 10 is an instant photography film pack of the type utilized in Polaroid® instant cameras such as the SX-70®. Such a pack contains batteries for operating the drive train which causes exposed film in the pack to be expelled therefrom and out of the camera body and also for operating a camera flash arrangement. Sufficient residual power is built into the batteries of such film packs to adequately operate the flashlight of the present invention even after the film pack has been utilized fully in a camera.

The power source-containing chamber also contains means, illustrated by cross-bar 12, for maintaining the power source at least loosely therein and, additionally, for guiding the power source into the chamber. As will be appreciated, a number of such cross-bars may be employed which confine the power source on both its upper and lower surfaces such that the power source itself does not come in contact with bottom wall 2.

Means for establishing electrical contact between the power source 10 and the illuminating means, i.e., the bulb 8 are provided in FIG. 1 in the form of conductive metal contacts 13 and 14, physically attached to partition 6 having extending parts adapted to engage the exposed terminals 11 of the battery-containing power source 10. Contacts 13 and 14, as shown, are connected by suitable conductive wires to bulb 8, where they are physically attached. However, the connection between the metal contacts and the bulb may also be effected by extending parts of the metal contacts 13 and 14 so as to engage bulb 8.

In operation of the flashlight shown in FIG. 1, battery-containing power source 10 is slidably inserted into the power source-containing chamber such that battery terminals 11 engage the extending ends of metal contacts 13 and 14 to cause power to be transmitted to the illuminating means. The flashlight of FIG. 1 may optionally further contain a top wall or cover and a back wall adapted to be opened and closed, for example, with standard hinge and fastening means, to secure the power source in place in the flashlight in contact with the metal contacts.

Figure 2:
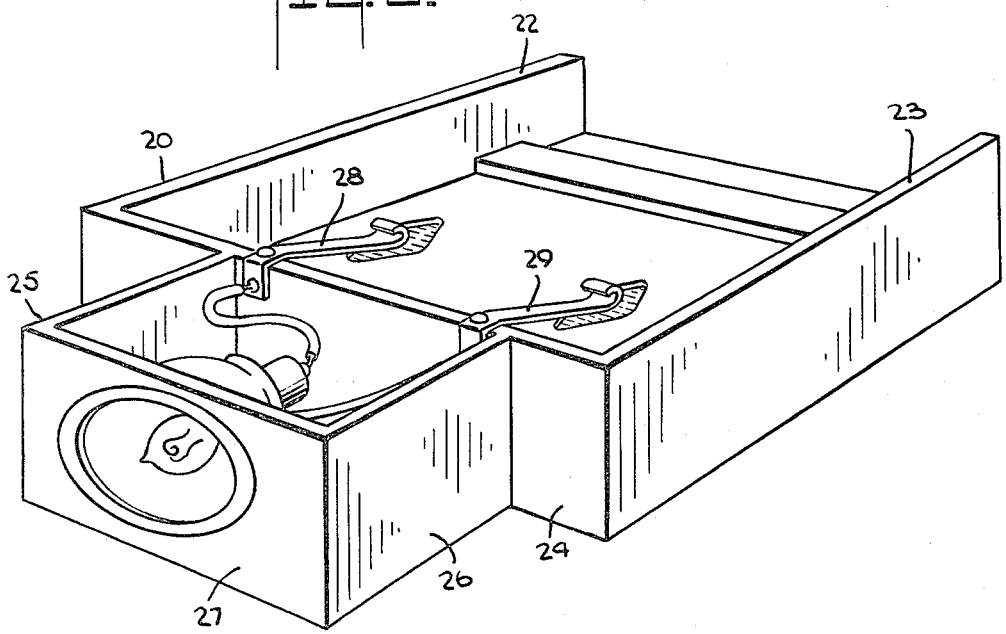
FIG. 2 is a view of the flashlight of this invention illustrating an embodiment wherein the second chamber is defined by walls distinct from those of the power source-containing chamber.

FIG. 2 depicts an alternate embodiment of the flashlight of the present invention wherein the walls defining the chambers containing the illuminating means and the power source are not all common or contiguous. Thus, flashlight 20 is comprised of a power source-containing chamber defined by bottom wall 21 having side walls 22 and 23 attached perpendicular thereto. Partition 24 defines the front wall of the power source-containing chamber and, as previously described in FIG. 1, may be attached to each of walls 21, 22 and 23, bottom wall 21 alone, side walls 22 and 23 alone or combinations thereof so long as sufficient structural strength is obtained.

The chamber containing the illuminating means is defined by side walls 25 and 26, attached in a perpendicular plane to partition 24; and front wall 27, attached to side walls 25 and 26, and containing a suitable aperture for light emission. Illuminating means are attached to front wall 27 and suitable means for establishing electrical contact between the illuminating means and the battery-containing power source provided in the form of conductive metal contacts 28 and 29 attached to partition 24.

In the embodiment of FIG. 2, the chamber containing the illuminating source may also be provided with top and bottom walls so as to completely encase the illuminating means, and, as in FIG. 1, the power source-containing chamber may contain both top and back walls.

The flashlight of the present invention may be constructed from any of the materials suitable therefore, e.g., plastic, metal, aluminum, wood and the like and may be constructed by physical attachment of one or more separate parts or in a single molded unit.

What is claimed is:

1. A battery-powered flashlight assembly, comprising:

(a) a power source-containing chamber adapted to receive a substantially flat power source containing one or more batteries and comprised of a bottom wall, side walls attached in substantially perpendicular relationship to said bottom wall and a partition wall defining the front of said chamber, said partition wall being attached to at least one of said bottom and side walls;

(b) means attached to the inner surface of at least one of said side walls within said power source-containing chamber for substantially confining a substantially flat power source within said chamber;

(c) a second chamber for containing illuminating means comprised of at least two parallel side walls attached in a substantially perpendicular relationship to said partition wall and a front wall attached to each of said parallel side walls and in a substantially parallel relationship to said partition wall, said front wall containing an aperture for transmission of light therethrough;

(d) illuminating means contained within said second chamber said illuminating means attached to said front wall and positioned behind the aperture in said front wall so as to permit light to emanate from said aperture;

(e) means attached to said partition wall for establishing electrical contact between said illuminating means and exposed terminals of said power source.

2. The flashlight of claim 1 wherein the side walls of said power source-containing chamber and said second chamber are common, contiguous walls.

3. The flashlight of claim 2 wherein said second chamber further comprises a bottom wall which is common to and contiguous with said bottom wall of said power source-containing chamber.

4. The flashlight of claim 3 wherein said illuminating means comprises a reflective housing surrounding a bulb having an exposed terminal within said second chamber.

5. The flashlight of claim 4 wherein said means for establishing electrical contact between said illuminating means and said power source comprise conductive metal contacts in electrical contact with said bulb and adapted to be in physical and electrical contact with exposed terminals of a substantially flat, rectangular battery-containing power source, said exposed terminals of said power source being on the upper surface thereof when positioned within said power source-containing chamber.

* * * * *